US007712823B2

(12) United States Patent
Greuter et al.

(10) Patent No.: US 7,712,823 B2
(45) Date of Patent: May 11, 2010

(54) ARMORED VEHICLE

(75) Inventors: Adolf Greuter, Ermatingen (CH); Hans-Jorg List, Friedrichshafen (DE)

(73) Assignee: Mowag GmbH, Kreuzlingen (CH)

( * ) Notice: Subject to any disclaimer, the term of this patent is extended or adjusted under 35 U.S.C. 154(b) by 260 days.

(21) Appl. No.: 11/990,372

(22) PCT Filed: Jul. 18, 2006

(86) PCT No.: PCT/IB2006/002276

§ 371 (c)(1),
(2), (4) Date: Feb. 12, 2008

(87) PCT Pub. No.: WO2007/020531

PCT Pub. Date: Feb. 22, 2007

(65) Prior Publication Data

US 2009/0140545 A1 Jun. 4, 2009

(30) Foreign Application Priority Data

Aug. 18, 2005 (EP) ..... 05405483

(51) Int. Cl.
*B60J 7/00* (2006.01)

(52) U.S. Cl. ..... 296/187.07; 296/193.07

(58) Field of Classification Search ..... 296/187.07, 296/190.07, 193.07, 203.01, 204; 180/89.12; 280/781; 89/36.8
See application file for complete search history.

(56) References Cited

U.S. PATENT DOCUMENTS

| | | | | | |
|---|---|---|---|---|---|
| 3,176,585 | A | * | 4/1965 | Ruf | 89/36.08 |
| 4,676,545 | A | * | 6/1987 | Bonfilio et al. | 296/193.04 |
| 4,934,246 | A | * | 6/1990 | Benson et al. | 89/36.14 |
| 6,149,226 | A | * | 11/2000 | Hoelzel et al. | 296/181.1 |
| 6,477,934 | B1 | * | 11/2002 | Bruhn et al. | 296/187.05 |
| 6,658,984 | B2 | * | 12/2003 | Zonak | 89/36.08 |
| 6,798,343 | B2 | * | 9/2004 | Carrier et al. | 340/539.13 |
| 7,255,034 | B2 | * | 8/2007 | Strassgurtl et al. | 296/193.07 |
| D552,507 | S | * | 10/2007 | Hammick | D12/12 |
| 7,357,062 | B2 | * | 4/2008 | Joynt | 296/193.07 |
| D593,450 | S | * | 6/2009 | Green et al. | D12/12 |

FOREIGN PATENT DOCUMENTS

| | | |
|---|---|---|
| DE | 197 40 103 | 3/1999 |
| EP | 0 828 134 | 3/1998 |
| EP | 1 291 610 | 3/2003 |

* cited by examiner

*Primary Examiner*—Kiran B. Patel
(74) *Attorney, Agent, or Firm*—Ladas and Parry LLP

(57) ABSTRACT

The armored vehicle (1), showing a bottom and a top shell (4, 5) has a reinforced floor structure for protection against mines, in that the floor area (6) of the subshell (4) is connected rigidly with an inner floor plate (7) via bracing elements (13, 14, 15) having longitudinal and transverse walls, which are also connected with the side walls (11, 12) of the subshell (4) along their borders (9, 10). The minimum height of the stiff bracing elements (13, 14, 15) corresponds to distance provided for the arrangement of a drive shaft between the inner floor plate (7) and the floor area (6).

10 Claims, 2 Drawing Sheets

ARMORED VEHICLE

Figure 1:
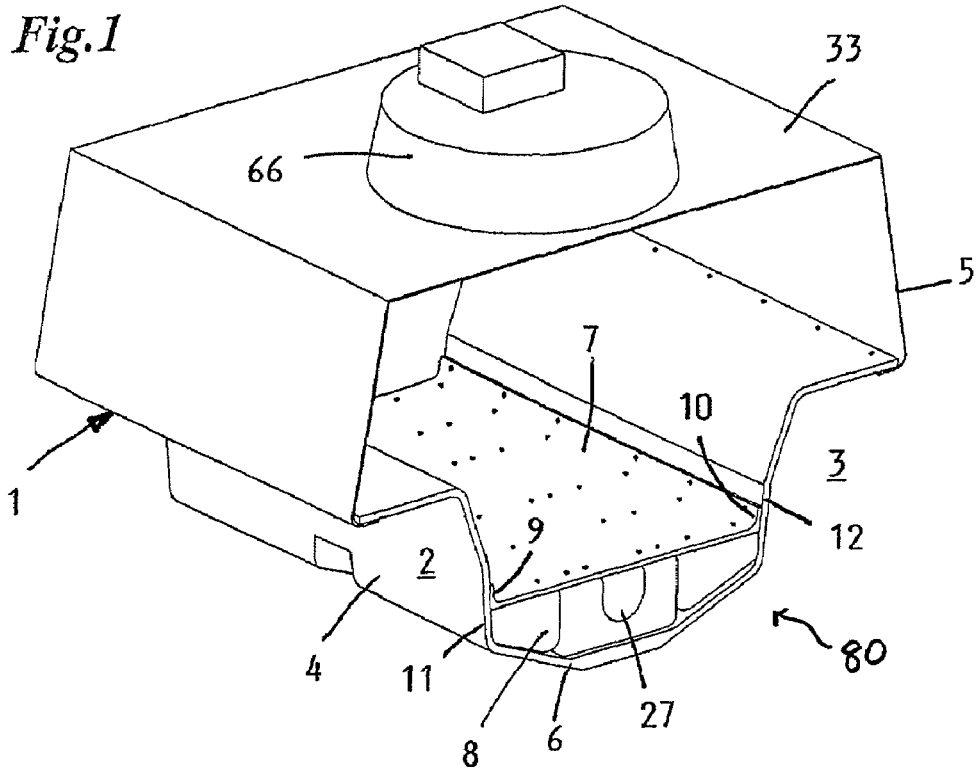

The invention relates to an armored vehicle with a pan-shaped subshell including wheel area walls on the side and a top shell connected to this enclosing the occupants' area, whereby an inner floor plate is fixed with distance above the floor area of the subshell.

From DE-A-19605230 and DE-A-19740103 it is known to fix a shield below the floor of the vehicle to protect against the effect of mines. However, such a shield does not suffice against mines with a high explosive force, such as the ones corresponding to a quantity of explosives equivalent to more than 6 kg of TNT.

The damping provided as per the DE-A-19605230 based regulation cannot prevent, due to its inadequate flexural strength, that the accelerations appearing due to the pressure of the explosion of the mines deform the floor area of the vehicle, which then penetrates into the inside of the vehicle to such extent that the survival chance for the occupants become very low.

The mounting of a plate reinforced by formed ribs as suggested by DE-A-19740103 leads only to an additive, inadequate improvement of the flexural strength of the protective design, since only the plate showing the ribs is reinforced, together with the risk that the free cross-sectional ends of the ribs act like a chipper knife on the adjacent counter punch under the effect of the blast force of a mine. Added to this is that the metallic construction of this shield, under the effect of the hollow charge penetrating the plating, leads to a fragmentation cone that spreads relatively broadly in the inside area, so that in all probability the occupants will be affected. By an external attachment of a shield below the floor of the vehicle, there is a greater proximity to the mine with a correspondingly higher load caused by the explosion force of the mine and also a lowering of the ground clearance of the vehicle, together with a considerable rise in the weight of the vehicle.

The basic object of the invention is to find an improved protection for the type of vehicles mentioned above against the effect of the mines, while avoiding the principal disadvantages mentioned above in the known designs. Accordingly, the reinforcements serving as protection against the mines are to be integrated in the vehicle design such that for a relatively low increase in weight and for none or negligible reduction of the ground clearance of the vehicle, bare minimum deformations to the inside of the vehicle from the effect of the mine explosion and accordingly the structural deformation occurring in the vehicle as a result of the mine effect is made non-fatal for the occupants.

The solution corresponding to this object is incorporated in a vehicle mentioned earlier such that the inner floor plate comprises a border running parallel to the side walls of the subshell, through which it is connected in shear-resistant manner and that several bracing elements rigidly connect the inner floor plate with the floor area of the subshell, so that the inner floor plate with the floor area of the subshell forms a bending resistant floor structure, integrated in the vehicle, in cross-section according to the type of the upper flange and lower flange of a transverse beam.

Figure 2:
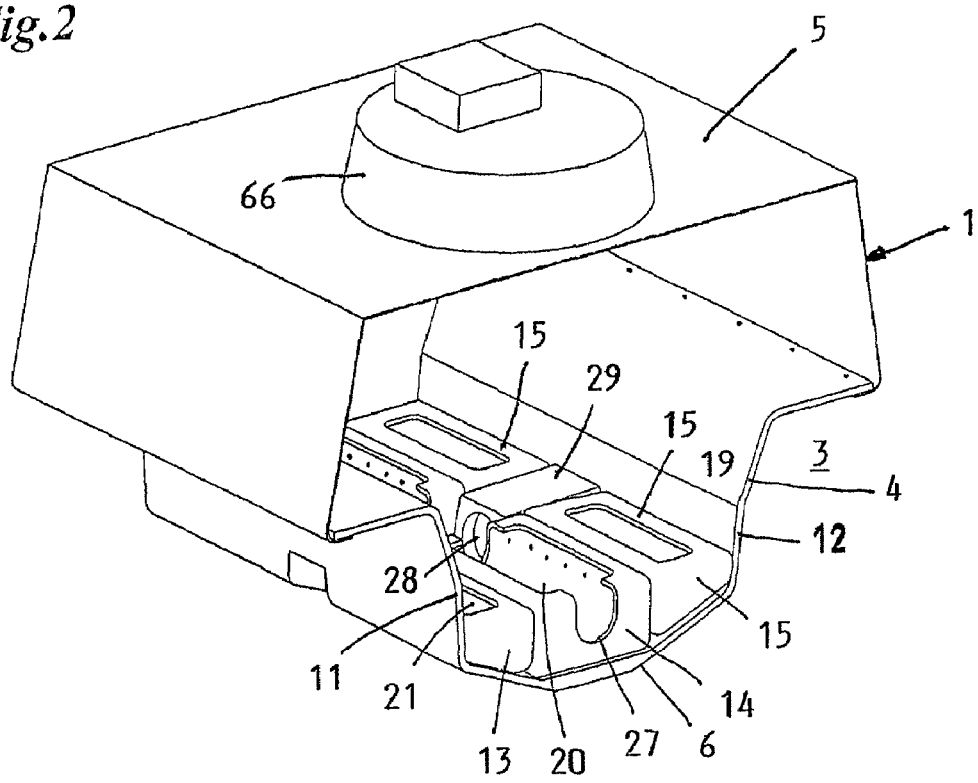
Figure 3:
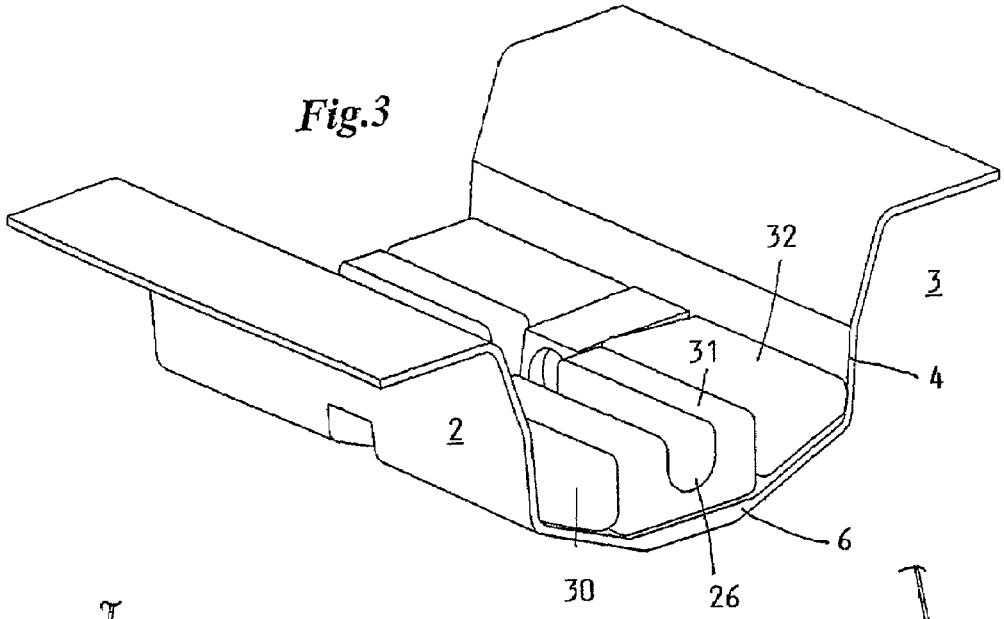
Figure 4:
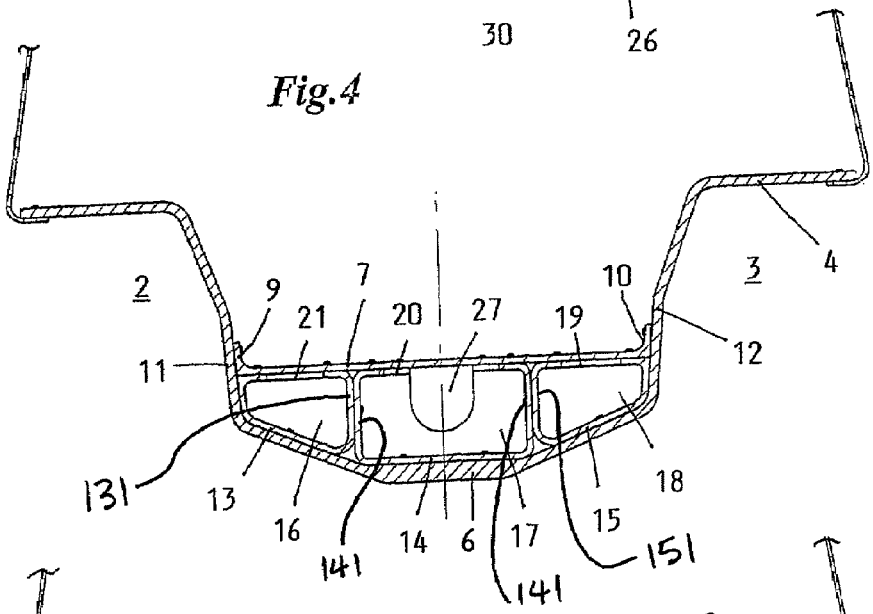
Figure 5:
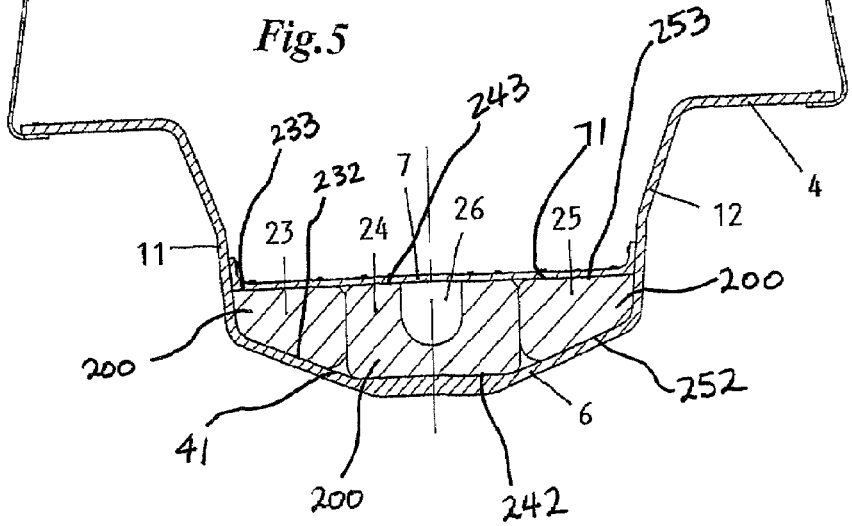

Advantageous embodiments of the invention are the object of the related patent claims and can be taken from the following description of an embodiment with the help of drawings. The drawings show the following:

FIG. 1 A perspective view of the longitudinal section of a vehicle as per the invention, FIG. 2 The longitudinal section as per FIG. 1 before the integration of the inner floor plate of the vehicle, FIG. 3 A perspective view of an embodiment of the subshell of a vehicle as per the invention, FIG. 4 A cross-section of a subshell of a vehicle as per the invention, reinforced by hollow bracing elements, and FIG. 5 A representation according to FIG. 4 with filled bracing elements.

The schematic representation of vehicle 1, shown as an example, with the help of which the invention will be described in more detail, has the cross-sectional form clearly shown in FIGS. 1 and 2, with a subshell 4 forming sidewise wheel clearances 2, 3 and a top shell 5 rigidly fixed to this by means of screws, or rivets. Both the wheel clearances 2, 3 together can have four, six, eight or more individually driven wheels or also several drive or guiding wheels of a crawler.

The top shell 5 is designed according to the purpose of use of the vehicle, for instance, an observation or a gun tower 66. To protect it against the projectiles, the top shell 5 can be made from ferrous or non-ferrous metals and can have retrofitted armor plates, not shown here, customized for the purpose of use.

The subshell 4 is preferably designed from a fibre-reinforced, tough plastic material and has a very high wall thickness at least in the lowermost and the middle portion of its pan-shaped floor area 6, depending upon the type of the shield. However, the subshell 4 can also be designed from the same material as that of the top shell 5, such as ferrous or non-ferrous metals.

Over the floor area 6 the vehicle 1 has an accessible inner floor plate 7, which are quite far from the foot rests meant for the occupants. The foot rests are not shown here. As a result of the thus created floor area 8, a drive shaft (not shown here) extends in the longitudinal direction of the vehicle, several gear shafts, torsion springs, supply strands running transverse to this, so that owing to their space requirements there is a minimum distance between the floor area 6 and the inner floor plate 7.

For implementing a bending resistant floor structure (80) with a high load bearing capacity, the inner floor plate 7 is connected at its borders via one-piece border flanges 9, 10 with the upward aligned side walls 11, 12 of the subshell 4 and also across the longitudinal direction of the vehicle via parallel and consecutive bracing elements 13, 14, 15 with the floor area 6 of the subshell 4.

An additional rigidness contributing to the stiffness of this floor structure is also provided for, between the bracing elements 13, 14, 15. The border flanges 9, 10 connect to the inner floor plate 7 on one or both the sides, so that their flanges have an L- or T-shaped cross-section.

The connections mentioned are preferably detachable e.g. designed through studs not shown here, so that the vehicle components enclosed by the bracing elements 13, 14, 15 are accessible. Instead of a bolted connection, at least in the sub-areas of surface contacts, an adhesive or a rivet connection can also be provided.

Such a floor structure made of shear-resistant plates, connected to one another with the mentioned minimum distance, forms a cross-sectional profile with a high capacity for carrying loads, in which according to the laws of statics, owing to the load expected from below as a result of the effect of the mines, the floor area 6 is comparable with the upper flange and the inner floor plate 7 with the lower flange of a transverse beam. As a result, the floor structure can absorb very high forces and distribute these over the entire vehicle, than when the individual stiffness of the floor area 6 of the subshell 4 and of the inner floor plate 7 would only add up in case of bending or buckling loads.

The embodiments given here show three bracing elements 13, 14, 15 arranged across the direction of the vehicle, which form hollow spaces 16, 17, 18 as shown in FIG. 4 and which shows openings 19, 20, 21 on the top as shown in FIG. 2, through which the bolt connections 22 can be established.

In accordance with the embodiment given in FIG. 5, the bracing elements 23, 24, 25 comprise of hollow bodies also adjusted to the contour of the cross-section of the floor structure, which, however, are filled with a filler material (200) to provide an additional reinforcement and/or increasing the protection, for instance, against projectile-forming mines. Metal or plastic foam is suitable for such a filling. The bracing elements 23, 24, 25 have first outer surfaces 232, 242, 252, which are connected to an inner surface 41 of the subshell 4 and second outer surfaces 233, 243, 253 connected to a lower side 71 of the inner floor plate 7.

Adjacent bracing elements 13-15, 23-25, 29-32 may be connected to one another in longitudinal and transverse directions so as to be shear-resistant along respective parallel running outer surfaces 131, 141, 151.

For bringing in a drive shaft of the vehicle, not shown here, the middle bracing element 14 or 24 has a recess 26, 27, u-shaped in its cross-section, open on the top or closed only by the inner floor plate 7. Further, box-shaped bracing elements 29, open below, are provided in the longitudinal direction of the vehicle 1 between similar bracing elements 13 and 15, which are narrow and which form a lead-through channel 28 for a gear shaft not shown here, which are screwed or riveted to the adjacent bracing elements 13 or 15 respectively.

The embodiment shown in FIG. 3 shows bracing elements 30, 31, 32, closed on all sides, reinforced, for instance, through metal foam and glued to one another, before fixed on to the inner floor plate 7.

It shall be understood that in the scope of the described invention there are numerous additional embodiments, which have one common advantage that they lead to a highly effective protective design against the mines, integrated in the vehicle, with relatively low increase in weight and low change in the ground clearance of the vehicle.

In order to further distribute the explosion forces acting on the stiff floor structure, designed as per the invention, from it to the entire vehicle, support elements can be provided on the side walls 11, 12 of the subshell 4 in a way not shown here, which establish a connection till the roof 33 of the top shell 5, as is known from the DE-A-10144208 of the applicant.

The invention claimed is:

1. An armored vehicle comprising:

a pan-shaped subshell (4) including side walls (11, 12) and a floor area (6), a top shell (5) connected to the subshell (4) to define an occupants' area, and an inner floor plate (7) secured at a distance above the floor area (6) of the subshell (4), wherein the inner floor plate (7) comprises:

borders (9, 10) running parallel to the side walls (11,12) of the subshell (4), the borders (9, 10) being connected to the side walls (11, 12) so as to be shear-resistant, and a plurality of bracing elements (13-15; 23-25; 29-32) rigidly connecting the inner floor plate (7) with the floor area (6) of the subshell (4), so that the inner floor plate (7) and the floor area (6) of the subshell (4) form a bend-resistant floor structure (80), integrated in the vehicle.

2. An armored vehicle according to claim 1, wherein the bracing elements (13-15; 23-25; 29-32) are hollow bodies having first outer surfaces (232, 242, 252) connected to an inner surface (41) of the subshell (4) at a first end, and second outer surfaces (233, 243, 253) connected to a lower side (71) of the inner floor plate (7) at a second end.

3. An armored vehicle according to claim 2, wherein adjacent bracing elements (13-15; 23-25; 29-32) are connected to one another in longitudinal and transverse directions so as to be shear-resistant along respective parallel running surfaces (131, 141, 151).

4. An armored vehicle according to claim 2, wherein the bracing elements (13-15; 23-25; 29-32) are connected to one another and the inner floor plate (7) and the subshell (4) through rivets or bolts (22).

5. An armored vehicle according to claim 1, wherein at least some of the bracing elements (14, 24, 29) have a recess (27, 28) for components of the vehicle (1).

6. An armored vehicle according to claim 1, wherein the bracing elements (23-25) are reinforced by a filler material (200).

7. An armored vehicle according to claim 1, wherein the floor area (6) of the subshell (4) has a greater thickness.

8. An armored vehicle according to claim 1, wherein the subshell (4), the floor plate (7) and the bracing elements (13-15; 23-25; 29-32) are made of fiber-reinforced plastic.

9. An armored vehicle according to claim 1, wherein the bracing elements (13-15; 23-25; 29-32) are dimensioned to accommodate a drive shaft between the inner floor plate (7) and the floor area (6).

10. An armored vehicle according to claim 2, wherein the bracing elements (13-15; 23-25; 29-32) adjacent to one another in the longitudinal and the transverse direction are connected so as to be shear-resistant with one another along respective parallel running outer surfaces (131, 141, 151).

* * * * *